US005373894A

United States Patent [19]

Tomatsuri

[11] Patent Number: 5,373,894

[45] Date of Patent: Dec. 20, 1994

[54] INDOOR UNIT OF AIR CONDITIONER AND METHOD OF PACKING SAME

[75] Inventor: Kenichi Tomatsuri, Fuji, Japan

[73] Assignee: Kabushiki Kaisha Toshiba, Kawasaki, Japan

[21] Appl. No.: 83,483

[22] Filed: Jun. 30, 1993

[30] Foreign Application Priority Data

Aug. 25, 1992 [JP] Japan ..... 4-226111

[51] Int. Cl.[5] ..... F28F 13/12

[52] U.S. Cl. ..... 165/134.1; 165/122

[58] Field of Search ..... 165/76, 134.1, 121, 165/122; 62/262

[56] References Cited

U.S. PATENT DOCUMENTS 4,416,327 11/1983 Nakada et al. ..... 165/122

FOREIGN PATENT DOCUMENTS 98838 4/1989 Japan ..... 62/262

6219 1/1991 Japan .

274330 12/1991 Japan ..... 165/122

*Primary Examiner*—John Rivell

*Assistant Examiner*—L. R. Leo

*Attorney, Agent, or Firm*—Cushman, Darby & Cushman

[57] ABSTRACT

An indoor unit of an air conditioner comprises a body casing, an indoor side fan disposed inside the body casing, rim members disposed on an outer periphery of the indoor side fan and buffer protection members disposed so as to oppose to the rim members respectively for preventing the indoor side fan from being deformed. Each of the buffer protection members has a recessed fan receiving portion with a predetermined distance from the rim means so as to provide an arcuate shape or angled shape. The buffer protection member is detachably secured to the body casing in a cantilever support manner on an upstream side of the indoor side fan with respect to air flow in the indoor unit. When the indoor unit is packed in a packing case, the body casing is reversed upside down in its attitude and then accommodated in the packing case with this upside down state.

7 Claims, 6 Drawing Sheets

INDOOR UNIT OF AIR CONDITIONER AND METHOD OF PACKING SAME

BACKGROUND OF THE INVENTION

The present invention relates to an indoor unit of an air conditioner and a method of packing the same in a packing case or box for transportation or the like.

An air conditioner for carrying out heating or cooling operation and dehumidification operation includes a split type air conditioner comprising indoor unit and outdoor unit which are separated from each other. In the split type air conditioner, a cross flow fan as an indoor side fan driven by a motor is accommodated in a body casing of the indoor unit, and in an air conditioner of large capacity, when the cross flow fan is mounted to the body casing, a fan made of aluminium has been widely utilized because of its light structure for the reason of its size and lot.

In a case where an indoor unit of an air conditioner mounted with such cross flow fan is conveyed or transported, there is a fear of being plastically deformed by an impact during the transportation. When the air conditioner mounted with the deformed cross flow fan is installed and operated, an abnormal vibration may be caused, and the cross flow fan and a fan motor may cause a trouble caused by the abnormal vibration.

In a prior art technology concerning such conventional split type air conditioner for preventing the plastical deformation due to the impact, for example, during the transportation, the cross flow fan is transported in a state of being suspended by using a plurality of protection bands 2 as shown in FIG. 5. The protection band 2 is Guided along a front panel 5*a* of a body casing 5 from a blowoff port 4 through a suspension hook 3 and secured at its other end to an upper cabinet 5*b* of the body casing by means of band fastening screw 2*a*. In an actual transportation of the indoor unit 6 of the split type air conditioner, as shown in FIG. 6, the indoor unit 6 is accommodated in a packing case 7 with the body casing 5 of the indoor unit 6 upside down and a protection cushioning material 8 such as styrene foam is then packed in the space of the body casing 5. In thus manner, the packing case 7 is packed.

However, in this protection manner of the indoor unit of the conventional split type air conditioner, it is required to wind up the protection bands around the cross flow fan in a narrow space in the body casing, thus being troublesome and inconvenient when the indoor unit is assembled and accommodated in the body casing. Moreover, it is necessary to adjust the suspension strength of the protection bands, being also troublesome. There is also a fear of an undesired strain being applied to the cross flow fan from the protection bands.

Furthermore, there is no good workability for assembling the protection bands in the nallow space in the body casing and it is not to say that the attaching position of the protection bands is always uniform, thus giving no reliability for firm securing of the cross flow fan during the transportation of the indoor unit of the air conditioner.

Still furthermore, because the suspension hook is not positioned on a perpendicular line passing the center position of the cross flow fan accommodated in the body casing, the suspension force for the cross flow fan is weak or may be instable against an impact in an arrowd direction A in FIG. 5 during the transportation, this also constituting a problem to the conventional protection method.

The disattachment of the protection bands at an installing portion after the transportation requires an additional time and labor, thus being inconvenient and disadvantageous.

SUMMARY OF THE INVENTION

An object of the present invention is to substantially eliminate defects or drawbacks encountered in the prior art and to provide an indoor unit of an air conditioner capable of easily effecting a protection of an indoor side fan of the air conditioner and preventing the indoor side fan from being plastically deformed by an impact from various directions and also provide an improved method of packing the indoor unit.

Another object of the present invention is to provide an indoor unit and a method of packing the same capable of eliminating disassembling of indoor fan protecting parts at an installation time of the air conditioner and of easily disassembling the protecting parts and then assembling the same as occasion demands.

These and other objects can be achieved according to the present invention by providing, in one aspect, an indoor unit of an air conditioner comprising:

a body casing;

an indoor side fan disposed inside the body casing;

a rim means disposed on an outer periphery of the indoor side fan; and a buffer protection means disposed so as to oppose to the rim means for preventing the indoor side fan from being deformed, the buffer protection means having a recessed fan receiving portion with a predetermined distance from the rim means, the buffer protection means being detachably secured to the body casing on an upstream side of the indoor side fan with respect to air flow in the indoor unit.

In a preferred embodiment, the indoor side fan is a cross flow fan having a horizontal axis, the rim means comprises a plurality of rim members disposed on the outer periphery of the cross flow fan with substantially equal spaces with each other along the axial direction thereof and the buffer protection means comprises a plurality of buffer protection members disposed so as to oppose to the rim members, respectively. The buffer protection means is detachably secured to the body casing in a cantilever support manner so as to provide an elastic property to the buffer protection means.

The cross flow fan has a cylindrical outer configuration in the axial direction and each of the buffer protection members has a recessed fan receiving portion having an arcuate shape substantially corresponding to the cylindrical outer configuration of the cross flow fan. The distance between the outer periphery of the cross flow fan and the arcuate fan receiving portion is about 5 to 10% in a length of a diameter of the cross flow fan.

The cross flow fan has a cylindrical outer configuration in the axial direction and each of the buffer protection member has a recessed fan receiving portion having an angled shape having an angle top projecting outward of the cross flow fan, the angle top being positioned on a perpendicular line passing a fan center of the cross flow fan so as to provide a symmetrical shape with respect to the angle top.

An angle constituted by both ends of the recessed fan receiving portion and the axial center of the cross flow fan is more than about 60°.

In another aspect of the present invention, there is provided a method of packing an indoor unit of an air conditioner in which an indoor side fan is disposed inside a body casing of the indoor unit, a rim means is disposed on an outer periphery of the indoor side fan and a buffer protection means is detachably secured to the body casing so as to oppose to the rim means with a predetermined distance therefrom for preventing the indoor side fan from being deformed, the packing method comprising the steps of:

preparing a packing case in which the indoor unit is to be accommodated;

reversing the body casing upside down in its positional attitude; and accommodating the body casing with the upside down state maintained and then closing the packing case.

The packing method may further comprises the step of packing a protection cushioning material between the packed body casing and the packing case.

According to the characteristic features of the present invention described above, the buffer protection member for preventing the indoor side fan from being deformed is disposed on the upstream side of the fan so as to oppose to the rim member disposed on the outer periphery of the fan and the buffer protection member is merely secured to the body casing of the indoor unit. Accordingly, the protection parts and elements including the buffer protection member can be easily detached from the body casing, thus easily and surely performing the protection of the indoor side fan.

The buffer protection member is provided with a recessed fan receiving portion having an elastic property and opposing to the rim member of the indoor side fan, so that the deformation of the fan can be absorbed and prevented even if the direction of the deformation is slightly shifted.

Furthermore, since the buffer protection member is disposed opposingly to the rim member so as not to prevent the air flow inside the body casing of the indoor unit, thus not preventing the rotation of the fan. After the installation of the indoor unit, it is not necessary to remove the protection parts or members, thus eliminating working involved by such removal of the protection parts. The attachment or detachment of the buffer protection member can be easily done at the time of maintenance or inspection.

The nature and further features of the present invention will be made more clear through the following description with reference to the accompanying drawings.

DESCRIPTION OF THE PREFERRED EMBODIMENT

Figure 1:
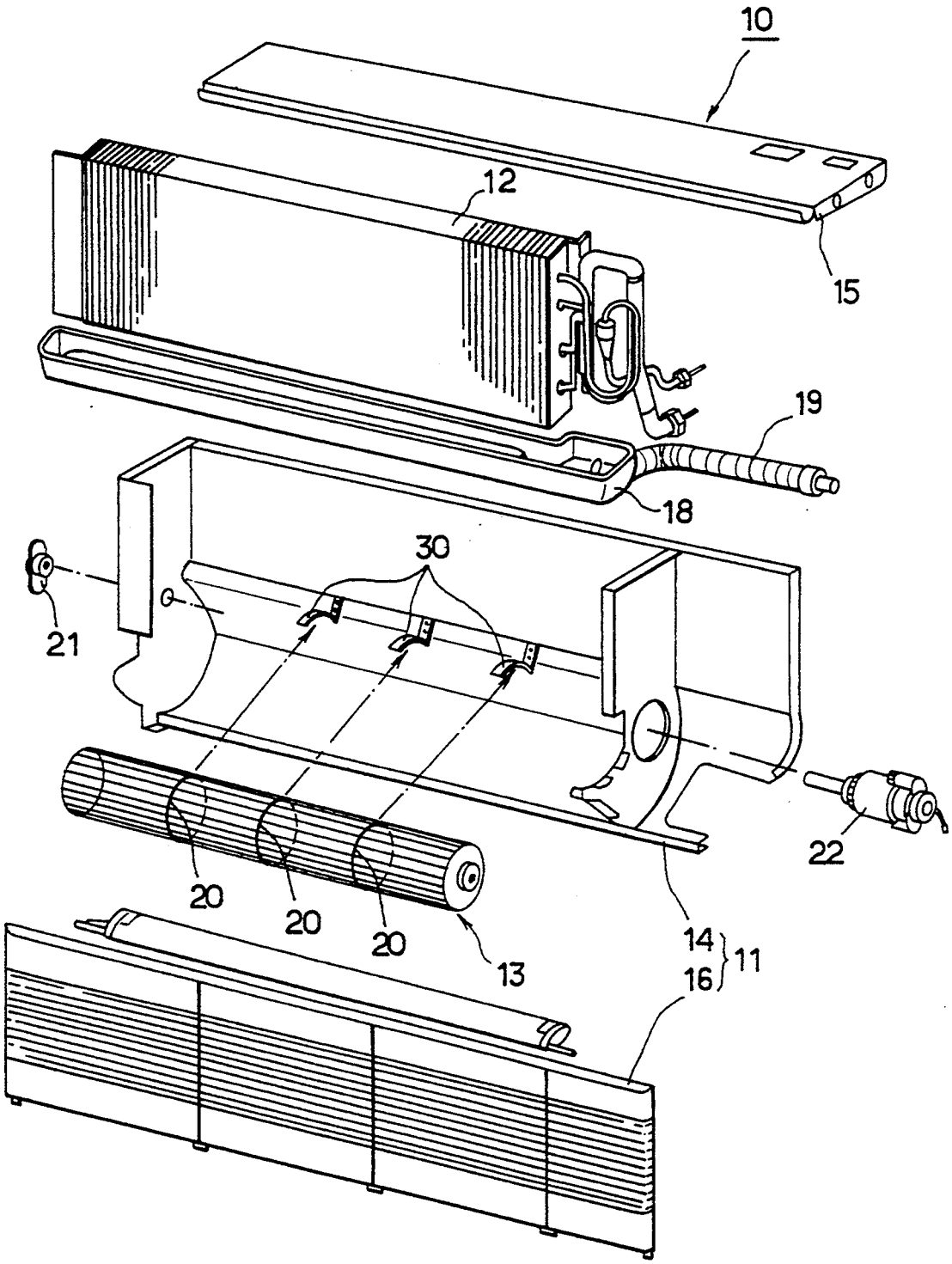
FIG. 1 is a developed perspective view of an indoor unit of an air conditioner according to one embodiment of the present invention.
Figure 2:
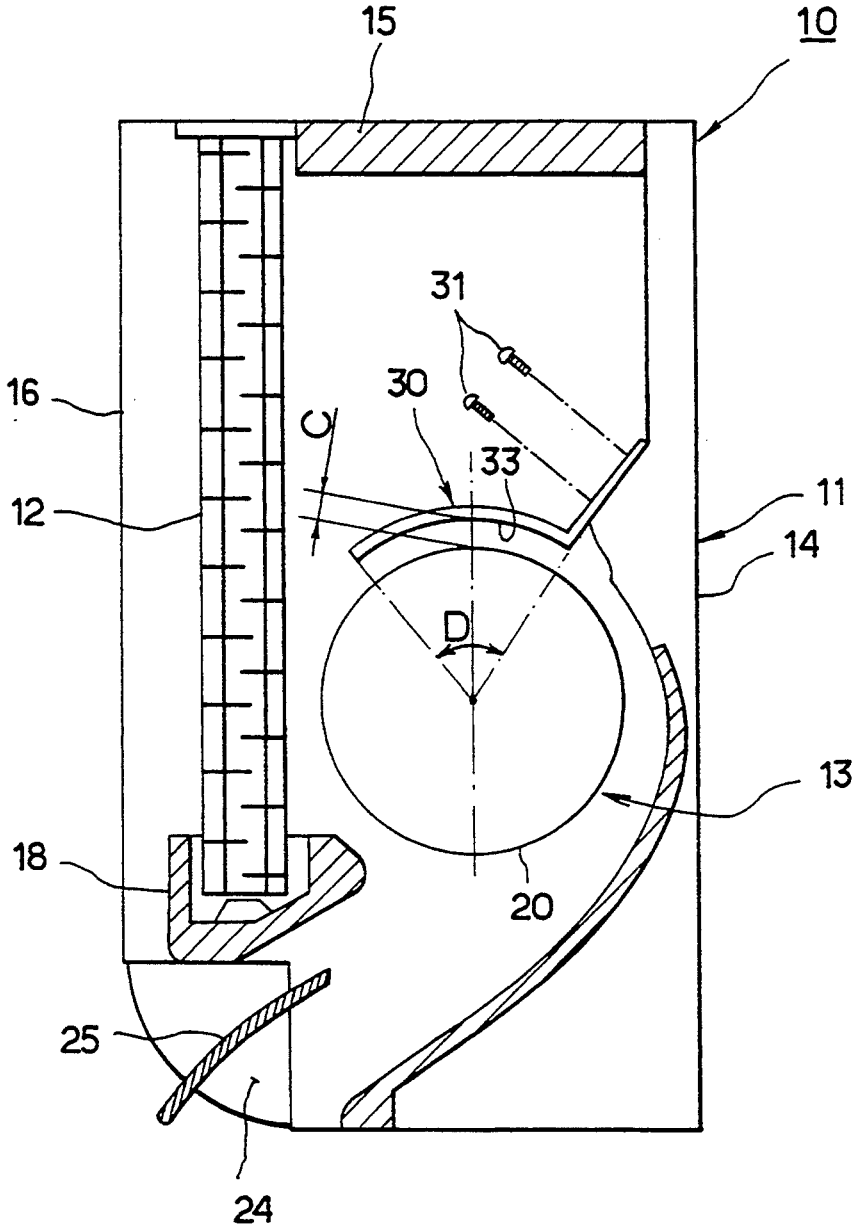
FIG. 2 is a sectional view of the indoor unit viewed from the side thereof.

FIG. 1 represents a developed perspective view of an indoor unit 10 of an air conditioner according to the present invention and FIG. 2 is a section viewed from the side of the indoor unit 10.

The indoor unit 10 of the air conditioner is provided with a body casing 11 in which an indoor side heat exchanger 12 and a cross flow fan 13 as an indoor side fan for example made of aluminium are accommodated. The body casing 11 is constructed by assembling an upper cabinet 15 and a front panel 16 on a rear casing 14.

The indoor side heat exchanger 12 is arranged so as to oppose to the front panel 16 at a portion on the suction upstream side, i.e. upstream side with respect to air flow, of the cross flow fan 13. A drain pan 18 is disposed below the indoor side heat exchanger 12 and drain collected in the drain pan 18 is discharged externally by means of a drain hose 19.

The cross flow fan 13 has generally a cylindrical outer configuration in its axial direction and is provided with a plurality of rims 20 arranged with spaces from each other in the axial direction thereof. This location of the rims 20 reinforces the stiffness of the fan 13, which is then supported by the rear casing 14 through a bearing 21. A fan motor 22 is connected to one side of the cross flow fan 13 and the cross flow fan 13 is rotated by the driving of the fan motor 22. The downstream side of the cross flow fan 13 is communicated with an air blowoff port 24 and the air blowoff direction is controlled by a louver means 25 disposed at the air blowoff port 24.

Figure 3:
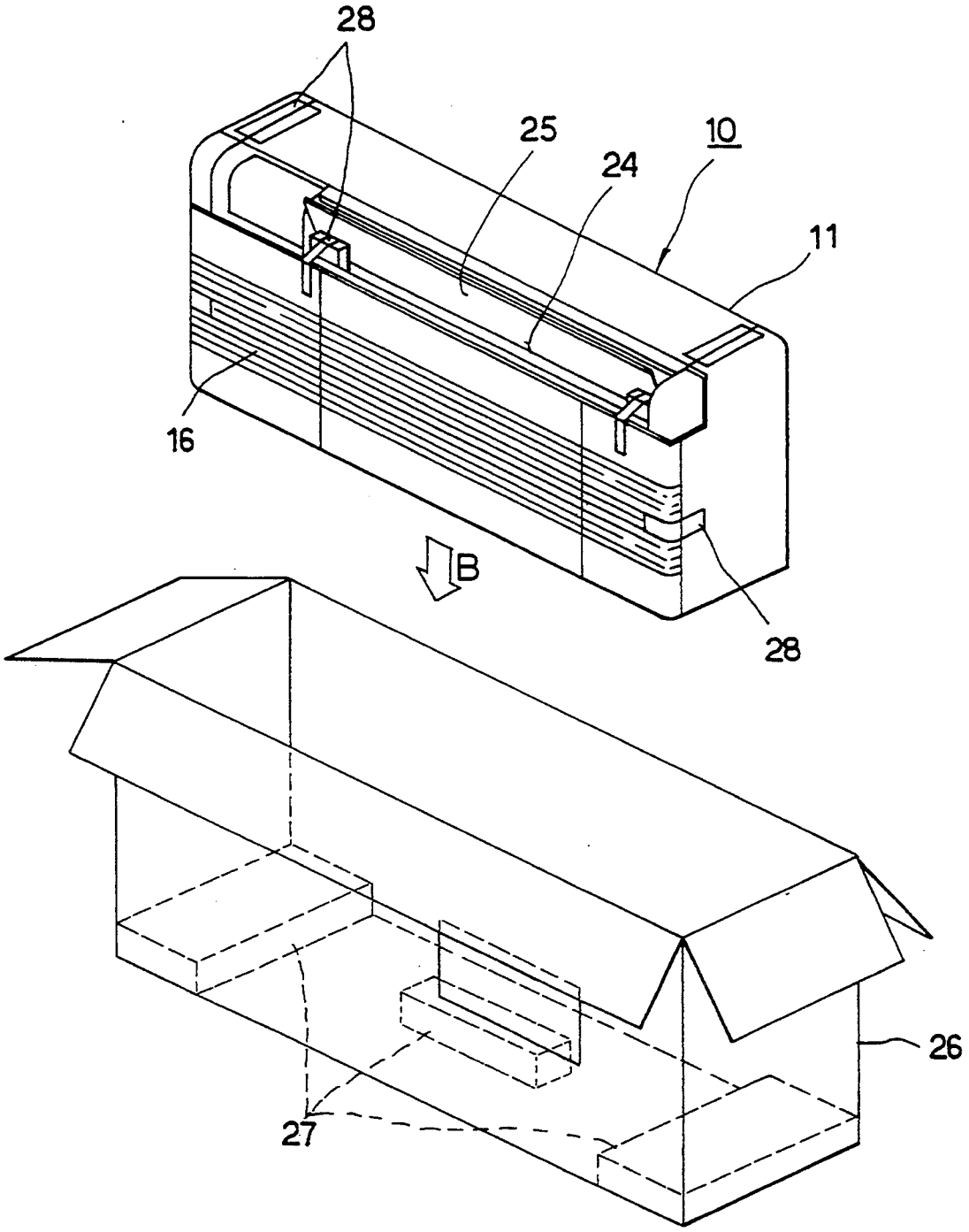
FIG. 3 is a perspective view for the explanatory of of the packing of the indoor unit of the air conditioner in a packing case.

By the way, the indoor unit 10 of the air conditioner is put into a packing case 26 with a state thereof reversed, i.e. upside down, in its attitude to an actual installing state as shown in FIG. 3, then, a protection cushioning material 27 such as styrene foam is packed into the space in the case 26 between the packed indoor unit 10 and the case 26, and finally, the packing case 26 is closed. As described above, since the indoor unit 10 is packed in a state reverse to that of the actual installation and transported as it is, it is necessary for an indoor part or element, particularly for the cross flow fan 13, to maintain its rigidity against an impact to be applied from an arrowed direction B. At the packing time of the indoor unit 10, movable parts or elements are safely protected by bonding them with, for example, a protection tape 28.

As shown in FIG. 1 or 2, a plurality of buffer protection members 30 for protecting the cross flow fan 13 from being deformed are secured detachably to the rear casing 14 of the body casing 11 by means of fastening screws 31, for example. These buffer protection members 30 are each bar like member so as to form, on the upstream side of the cross flow fan 13, a predetermined gap C from the rim 20 of the fan 13. Each of the buffer protection members 30 is secured at its one end to the rear casing 14 of the body casing 11 in a cantilever manner so as to provide an elastic property and has an inwardly recessed fan receiving portion 33 of generally arcuate shape which may abut against the rim 20 of the cross flow fan 13 and function as an impact receiver when it is deformed by the certain impact applied thereto. In this connection, is it desired that the gap C has a distance about 5 to 10% in length of the diameter of the cross flow fan 13 and has an arcuate shape as even as possible through an entire surface of the fan 13.

Further, a receiving angle D of the cross flow fan 13 received by the recessed fan receiver portion 33 of the buffer protection member 30 is for example of more than about 60° of central fan angle. Namely, an angle constituted by both end portions of the recessed fan receiving portion 33 and the axial center of the fan 13 is more than about 60°. Since the protection member 30 are disposed in opposition to the rims 20, having relatively high strength, of the cross flow fan 13, the plastic deformation of the cross flow fan 13 can be effectively prevented.

When it is required to assemble the buffer protection members 30 with the indoor unit 10 of the air conditioner, the upper cabinet 15 is first removed, and in this state, the assembling thereof can be performed together with the assembling of the unit constituting parts or elements merely by easily and surely fastening the buffer protection members 30 to the rear casing 14 by using screw means, for example, thus requiring no specific assembling working.

Furthermore, since the buffer protection member 30 is provided with the arcuate receiving portion 33, the cross flow fan 13 can be surely protected even if it is shifted by the impact during the transportation of the indoor unit of the air conditioner. The buffer protection member 30 has a bar-like shape and disposed opposingly to the rim 20 of the cross flow fan 13, so that the air flow in the body casing 11 is never obstacled, and accordingly, it is not necessary to remove the fan protection parts or elements such as the buffer protection members 30 at the installation of the air conditioner. At the maintenance or inspection time of the indoor unit 10, the buffer protection members 30 can be easily disassembled or removed only by loosening and removing the screws.

Figure 4:
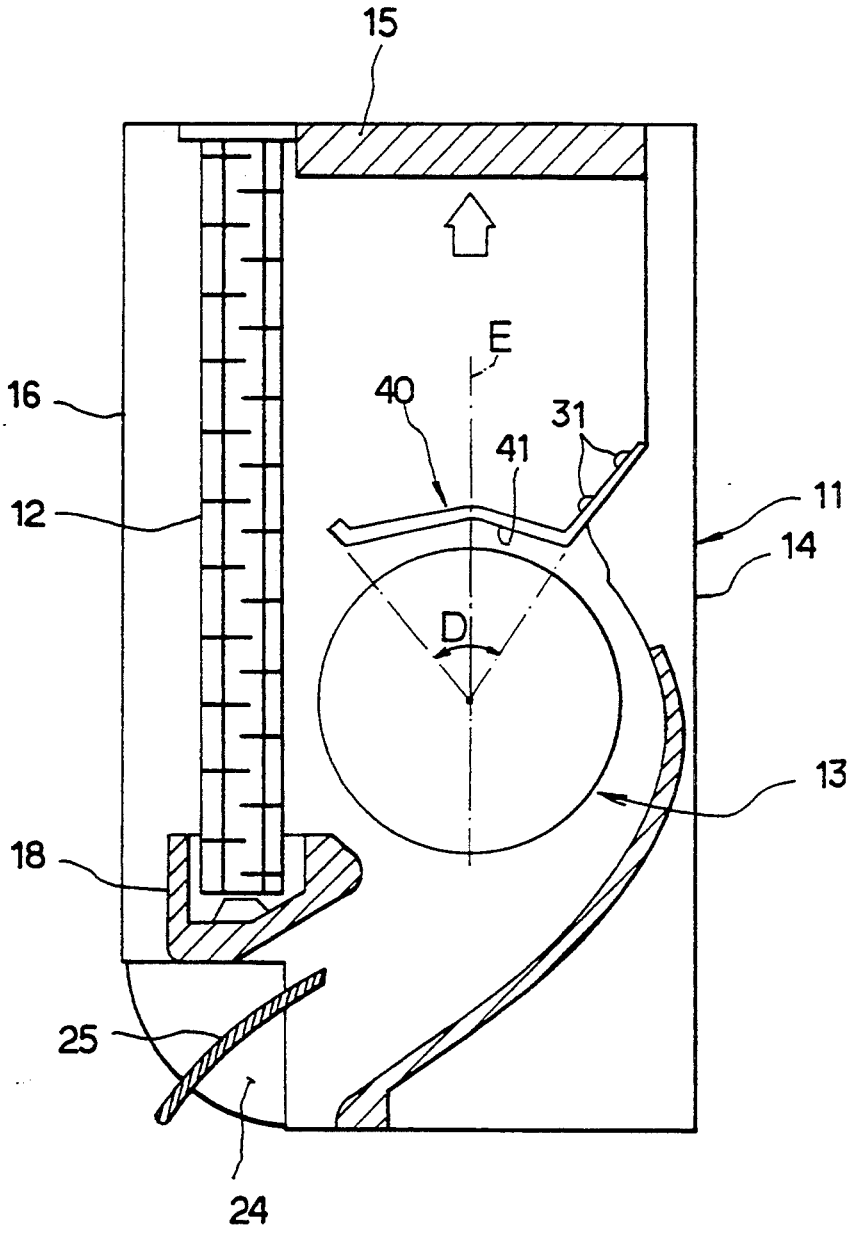
FIG. 4 is a view similar to that of FIG. 2 showing another embodiment of the indoor unit of the air conditioner according to the present invention.
Figure 5:
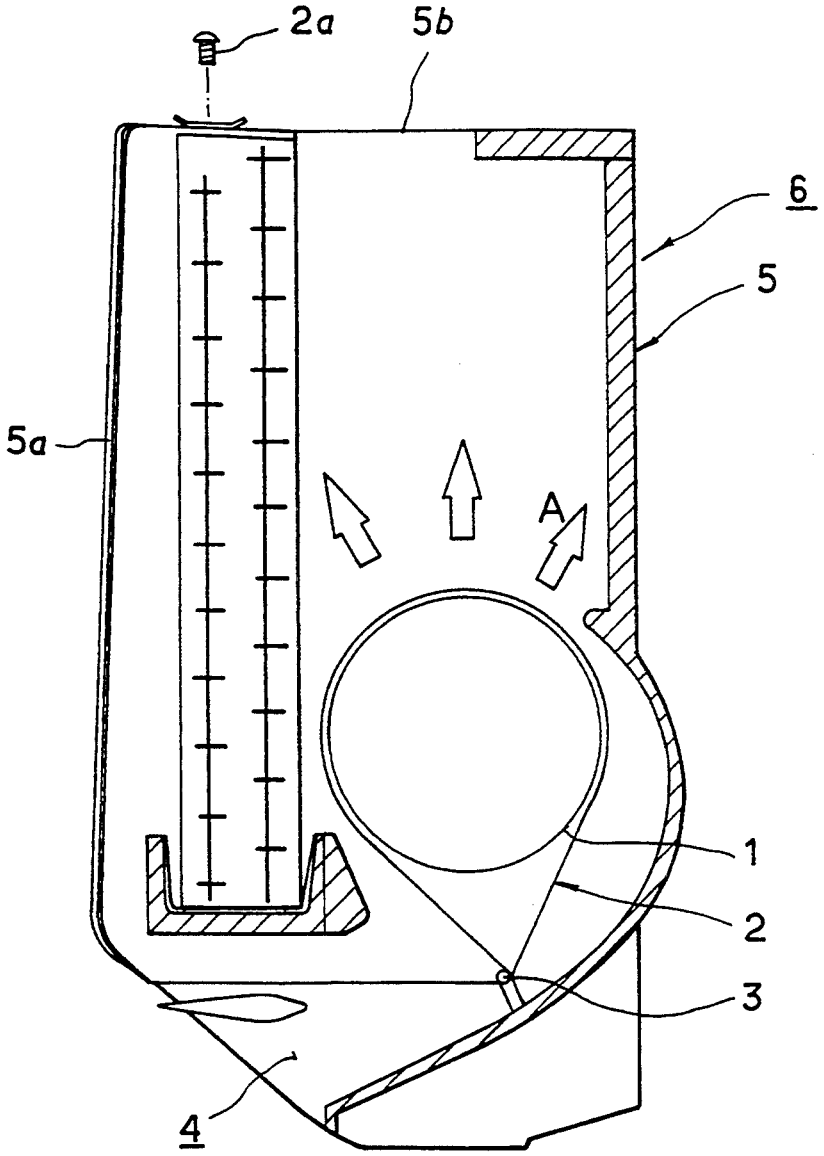
FIG. 5 PRIOR ART
FIG. 5 is a side sectional view similar to that of FIG. 2 or 4 but representing a conventional indoor unit of an air conditioner.
Figure 6:
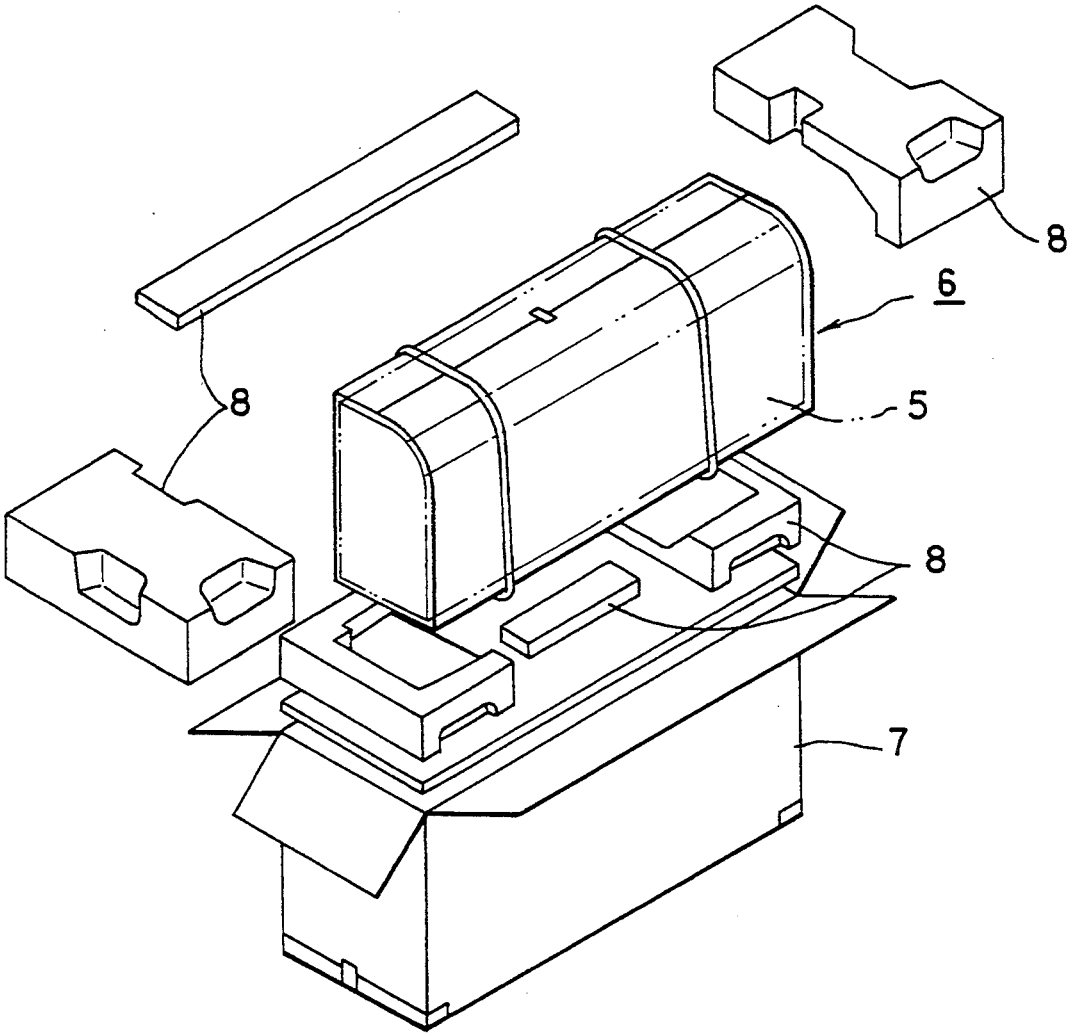
FIG. 6 PRIOR ART
FIG. 6 is a perspective view for the explanatory of of the packing of the indoor unit of the air conditioner of FIG. 5 in a packing case.

FIG. 4 represent another embodiment of the indoor unit of an air conditioner according to the present invention, in which like reference numerals are added to members or parts corresponding to those of the first embodiment, and the invention of this embodiment of FIG. 4 differs from that of FIG. 1 in a point that an indoor unit 10A of this embodiment is provided with buffer protection members 40 for preventing the deformation of the cross flow fan 13 having structures different from those 30 of FIG. 1 and 2.

Referring to the embodiment of FIG. 4, each of the buffer protection members 40 has a recessed fan receiving portion 41 having an angled shape as viewed from the side of the indoor unit 10A. Namely, at the installed state of the indoor unit, the angled top project upward as viewed in FIG. 4 but downward at the packing or transportation time of the indoor unit 10A. The angled top is positioned on a perpendicular line E passing the axial center of the cross flow fan 13, and the angled shape of the recessed fan receiving portion 40 is substantially symmetrical bilaterally with respect to this angle top.

It is to be noted that the shape of the buffer protection member is not limited to the arcuate or angled shape and other shape may be adopted according to the present invention and also noted that the present invention is not limited to the described embodiments and many other changes or modifications maybe made without departing from the scope of the appended claims.

What is claimed is:

1. An indoor unit of an air conditioner comprising:
a body casing;
an indoor side fan disposed inside the body casing;
a rim means disposed on an outer periphery of the indoor side fan; and
a buffer protection means disposed so as to oppose to the rim means for preventing the indoor side fan from being deformed, said buffer protection means having a recessed fan receiving portion with a predetermined distance from the rim means, said buffer protection means being detachably secured to the body casing on an upstream side of the indoor side fan with respect to air flow in the indoor unit.

2. An indoor unit according to claim 1, wherein said indoor side fan is a cross flow fan having a horizontal axis, said rim means comprises a plurality of rim members disposed on the outer periphery of the cross flow fan with substantially equal spaces with each other along the axial direction thereof and said buffer protection means comprises a plurality of buffer protection members disposed so as to oppose to the rim members, respectively.

3. An indoor unit according to claim 2, wherein said buffer protection means is secured to the body casing in a cantilever manner so as to provide an elastic property to the buffer protection means.

4. An indoor unit according to claim 2, wherein said cross flow fan has a cylindrical outer configuration in the axial direction and each of said buffer protection members has a recessed fan receiving portion having an arcuate shape substantially corresponding to the cylindrical outer configuration of the cross flow fan.

5. An indoor unit according to claim 4, wherein the distance between the outer periphery of the cross flow fan and the recessed fan receiving portion is about 5 to 10% in length of a diameter of the cross flow fan.

6. An indoor unit according to claim 2, wherein said cross flow fan has a cylindrical outer configuration in the axial direction and each of said buffer protection member has a recessed fan receiving portion having an angled shape having an angle top projecting outward of the cross flow fan, said angle top being positioned on a perpendicular line passing a fan center of the cross flow fan so as to provide a symmetrical shape with respect to the angle top.

7. An indoor unit according to claim 2, wherein an angle constituted by both ends of the recessed fan receiving portion and the axial center of the cross flow fan is more than about 60°.

* * * * *